US005775570A

United States Patent [19]

Kim

[11] Patent Number: 5,775,570

[45] Date of Patent: Jul. 7, 1998

[54] FOOD CONTAINER ADAPTABLE FOR HOLDING A DRINK CUP

[76] Inventor: Hong R. Kim, 4340 Campus Dr., Newport Beach, Calif. 92660

[21] Appl. No.: 835,013

[22] Filed: Apr. 8, 1997

[51] Int. Cl.[6] ..... B65D 5/489; B65D 3/24

[52] U.S. Cl. ..... 229/4.5; 206/217; 220/738; 229/400; 229/904

[58] Field of Search ..... 229/4.5, 400, 904; 206/217, 541, 565; 220/530, 557, 737, 738

[56] References Cited

U.S. PATENT DOCUMENTS

| | | | |
|---|---|---|---|
| 2,803,390 | 8/1957 | Mackay . | |
| 3,288,344 | 11/1966 | Woollen et al. . | |
| 3,323,706 | 6/1967 | Gereke . | |
| 3,567,105 | 3/1971 | McFarlin . | |
| 4,353,476 | 10/1982 | Cowgill | 220/85 |
| 4,397,393 | 8/1983 | Pergande et al. | 206/549 |
| 4,491,220 | 1/1985 | Daviss | 206/217 |
| 4,620,631 | 11/1986 | Bartelt | 206/217 |
| 4,837,865 | 6/1989 | Roth | 229/904 |
| 4,936,481 | 6/1990 | Rosenfeld | 220/23.86 |
| 4,955,528 | 9/1990 | Schluckebier . | |
| 5,137,210 | 8/1992 | Hibbs | 229/400 |
| 5,180,079 | 1/1993 | Jeng | 220/705 |
| 5,348,218 | 9/1994 | Haire et al. | 229/904 |
| 5,524,814 | 6/1996 | Davis | 229/904 |

FOREIGN PATENT DOCUMENTS

| | | | |
|---|---|---|---|
| 2232356 | 12/1990 | United Kingdom | 206/217 |

*Primary Examiner*—Gary E. Elkins

*Attorney, Agent, or Firm*—Gene Scott - Patent Law & Venture Group

[57] ABSTRACT

A popcorn bucket type of food container is adapted for mounting a drink cup along one side. This is facilitated by providing score lines along which one side of the container may be folded concave inwardly while allowing one band of the folded-in side to extend outwardly for encircling the cup and a lower portion to extend outwardly as a cup support ridge. For longer cups a portion of the bottom of the container may be folded so that the lower part of the sidewall may be folded inwardly as well.

10 Claims, 3 Drawing Sheets

FOOD CONTAINER ADAPTABLE FOR HOLDING A DRINK CUP

BACKGROUND OF THE INVENTION

1. Field of the Invention

This invention relates generally to food and drink containers, and more particularly to a popcorn bucket type container having adaptation for receiving a drink cup.

2. Description of Related Art

The following art defines the present state of this field:

MacKay, U.S. 2,803,390 describes a dispensing box and cup support. This invention provides a simple and inexpensive popcorn box with means for conveniently dispensing the popcorn, supporting a paper cup in the box, and mounting the box assembly thus provided on the back of a seat, or the door or dash panel of an automobile.

Woollen et al., U.S. 3,288,344 describes a double container dispensing package. The invention comprises inner and outer cups, the inner cup shaped to hold an edible and to be received downwardly into the outer cup, the cups having interference fit limiting said downward reception with the cups then defining a liquid storage zone below the bottom of the inner cup, the side wall of the inner cup being displaced away from the side wall of the outer cup to provide for up and down displacement therebetween of a tubular straw without interference with the edible in the inner cup.

Gereke, U.S. 3,323,706 describes a container having a partition about midway of the height thereof that forms a lower compartment for a beverage and an upper compartment for a food, such as popcorn or the like, the partition having an opening for receiving a tubular member, such as a straw, for withdrawing the beverage from the lower compartment while the food is still in the upper compartment.

McFarlin, U.S. 3,567,105 describes a container including parallel opposite sidewalls and parallel opposite end walls disposed at generally right angles relative to the sidewalls. The container includes a partition spaced between and generally paralleling a first pair of the walls for folding with the first pair of the walls and extending between and connected to the other pair of walls for folding with the first pair of walls toward collapsed positions paralleling the latter.

Cowgill, U.S. 4,353,476 describes a holder for paint brushes and other paint applicators which is attachable to the paint container, and which is constructed of moisture resistant sheet or film-like materials to conform to and adhere to the container. The holder folds outward to form a pocket for the paint brush.

Pergande et al., U.S. 4,397,393 describes a carryout package for transporting a container of beverage in conjunction with other foods and the like, the container being initially collapsed as a two layer flat bland erectable to form a rectangular box with a generally triangular cross-section at the top.

Daviss, U.S. 4,491,220 describes a container for holding popcorn and a drink cup which has a box with a band mounted to one box wall beneath a slot. The box may be filled with popcorn and a drink cup held by the band to the box with a cup lip projecting into the slot.

Bartelt, U.S. 4,620,631 describes a device for holding two containers, such as a beverage cup and a food container. The device is formed of a strip of flexible material and includes a pair of end sections that extend circumferentially of a first container and are bonded to the side wall of the container.

The adjacent extremities of the end sections are bent radially outward and form a loop to receive and hold a second container.

Rosenfeld, U.S. 4,936,481 describes a unitary device for the delivery of two or more food items. The device has a first container having a bottom and at least one side wall which defines a first partially enclosed area and a second container having at least one side wall which defines a second partially enclosed area. The second container is adapted to be partially received by an aperture defined by the bottom of the first container. A first food item is located within the first partially enclosed area and second food item is located in the second container.

Schluckebler, U.S. 4,955,528 describes a paperboard container for food and condiments. The container is formed from a one piece blank cut from rectangular paperboard stock. The finished container has a first receptacle and an adjacent second fluid tight receptacle for condiments. The finished container may be collapsed to a flat condition for storage and may be stacked one upon another in the open position.

Jeng, U.S. 5,180,079 describes a combined cup for soft drinks that is constituted with an upper cup body and a lower cup body jointed together by a connecting body, and in the center of the connecting body, there is formed a nozzle sticking upward to the received into the nozzle sleeve formed on the upper cup body so as to keep both cup bodies firmly connected. The lower cup body is used to contain soft drinks while the upper cup body is used to contain solid snacks.

The prior art teaches the adaptation of food containers for use with drink cups, e.g., MacKay, Woollen et al, Gereke, Pergande et al, Daviss, Bartelt, Rosenfeld, and Jeng. However, these teaches have disadvantages such as not being able to see either the drink or the food during use; Jeng, Gereke, and Woollen et al; not holding the cup securely in order to avoid spills; MacKay, and Daviss; and finally, not functionally useful as a food container alone; Bartelt, Rosenfeld; and Farlin. Therefore, the prior art does not teach such a device that is useful as a food container alone, and yet is functionally adaptable for mounting a drink container on one side. The present invention fulfills these needs and provides further related advantages as described in the following summary.

SUMMARY OF THE INVENTION

The present invention teaches certain benefits in construction and use which give rise to the objectives described below.

The present invention provides a food container which is facilitated for supporting a drink cup at one side.

A primary objective of the present invention is to provide such a food container having advantages not taught by the prior art.

Another objective is to provide such a food container that is able to be used as a food container alone as well as a combination food container and drink cup and wherein the food as well as the drink are visible to the user at all times.

A further objective is to be able to use such a convertible food container enabling the mounting of a short and smaller, as well as a long and larger drink cups to afford universal use.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 2:
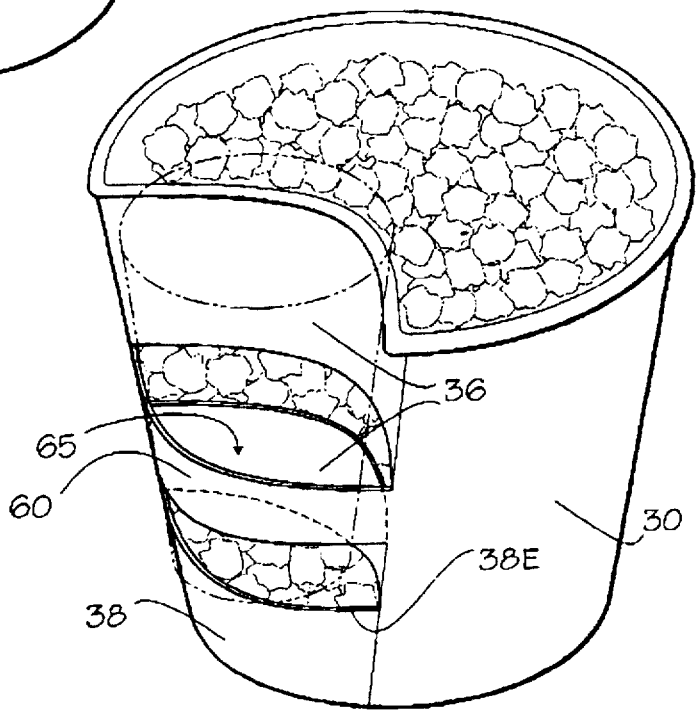
FIG. 2 is a perspective view of the preferred embodiment of the present invention as used for holding popcorn and as folded for holding a short drink cup.
Figure 5:
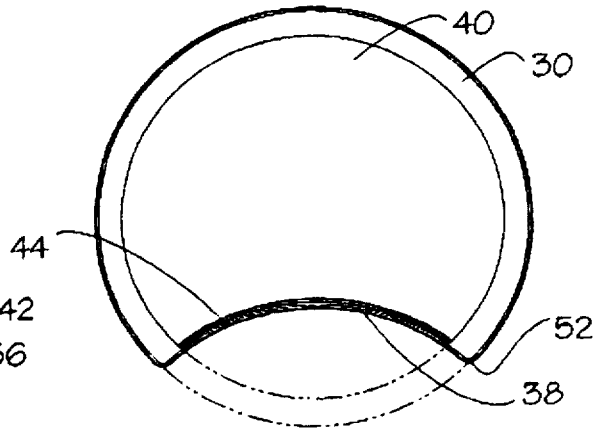
FIG. 5 is a sectional view taken along line 4—4 as shown in FIG. 3 and showing the bottom of the container after being folded into the form of FIG. 3.
Figure 6:
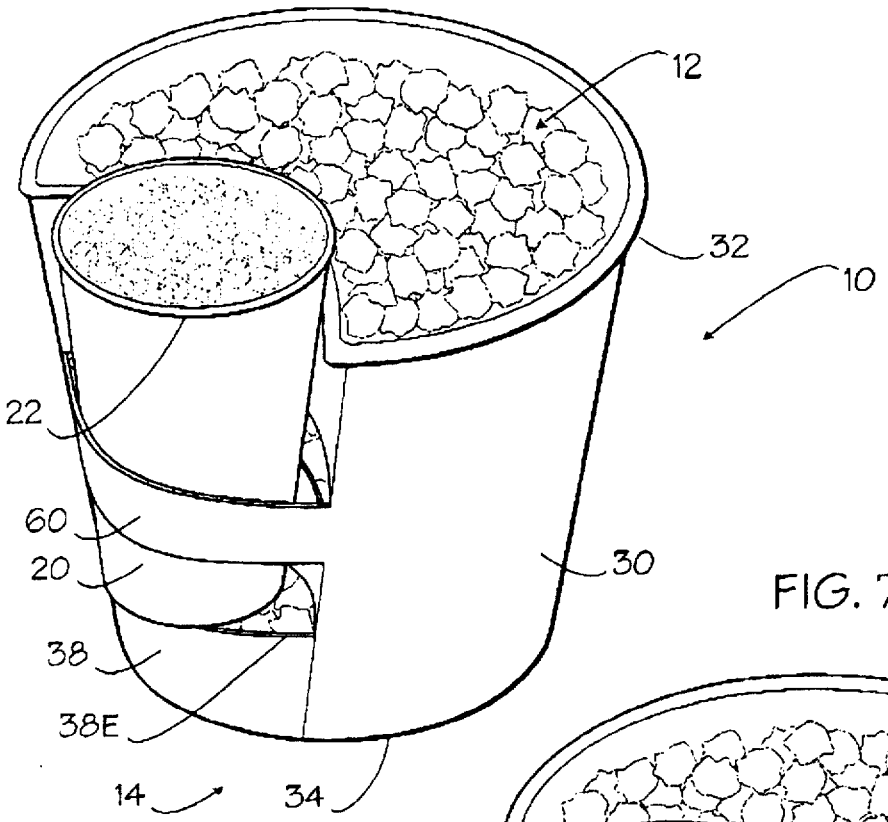
FIG. 6 is a perspective view of the preferred embodiment of the present invention as described as a combination with a short drink cup.
Figure 7:
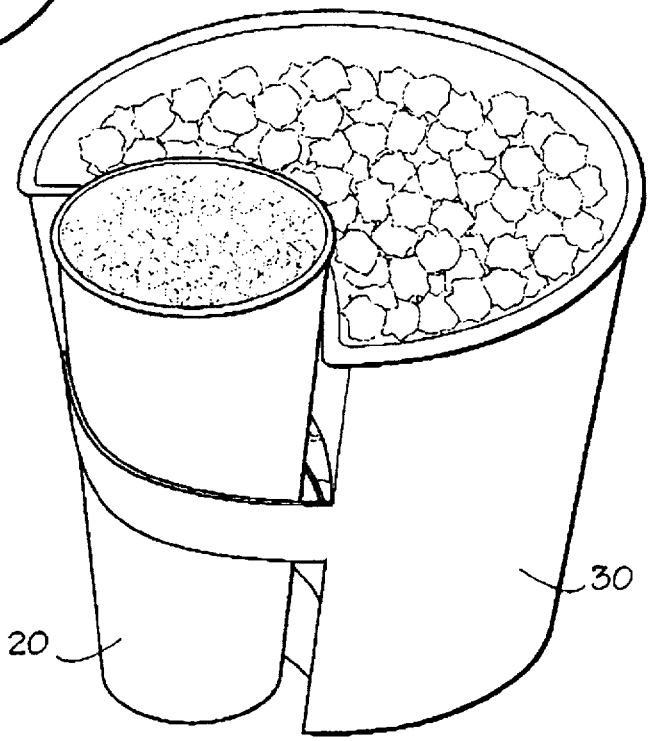
FIG. 7 is a perspective view of the preferred embodiment of the present invention as described as a combination with a long drink cup.

The above described drawing figures illustrate the invention a food containing device 10 for use with at least one drink cup 20 as best shown in FIGS. 6 and 7. An important use of the device is as a combination popcorn bucket and soft drink cup for use in a theatre. The containing device 10 may be fashioned to accept one or more soft drink cups 20, but this description will teach the use of only one such cup 20 and it is assumed that one of skill in the art will be able to enable the containing device 10 for accepting a second and further such cups 20 on the same containing device 10 as desired. The food containing device or container 10, provides a generally circular sidewall 30 providing a top 32 and a bottom 34 annular lips, the lips 32, 34 defining a top 12 and a bottom 14 respective openings into the container. A disk shaped bottom wall 40 (FIGS. 4 and 5) is joined with the sidewall 30 around the bottom wall's peripheral edge 36 and is positioned for covering the bottom opening 14. The sidewall 30 provides at least one cup holding enablement 50, each of the at least one cup holding enablements 50 comprising a first and a second linear score lines 52 extending, preferably convergently, between the top and the bottom lips 32 and 34 for folding a sidewall minor portion 36 of the sidewall 30 inwardly, as best seen in FIG. 2. A plurality of, spaced apart slits 38, preferably two, or three such slits 38 are positioned for extending between the score lines 52 for enabling at least one band portion 60 of the sidewall minor portion 36 to extend outwardly when the minor portion of the sidewall 36 is folded inwardly, the outwardly extending band portion 60, and the inwardly folded sidewall minor portion 36, together, forming an encircling member 65 for holding one of the at least one drink cup 20 securely on the food container device 10 as best seen in FIGS. 6 and 7.

Figure 4:
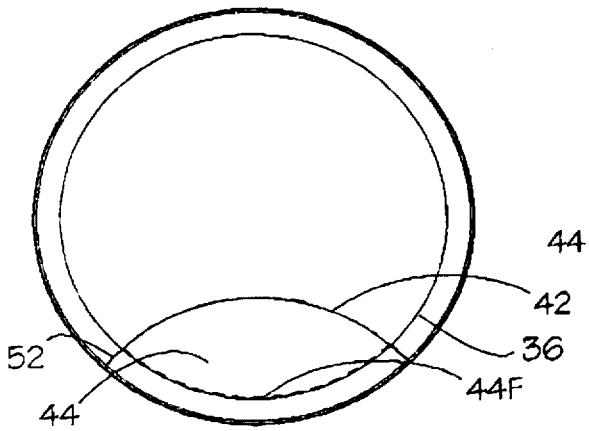
FIG. 4 is a sectional view taken along line 4—4 as shown in FIG. 3 and showing the bottom of the container prior to being folded into the form of FIG. 3.

As seen in FIGS. 4 and 5, the bottom wall 40 preferably includes, for each one of the at least one cup holding enablements 50, an arcuate slit 42 thereon, the arcuate slit 42 extending between a first 30A and a second 30B positions on the sidewall 30 to define a bottom wall minor portion 44 between the arcuate slit 42 and the sidewall 30, so that with the minor portion 44 of the bottom wall 40 folded against the sidewall 30, as seen in FIG. 5, the sidewall minor portion 36 may be folded inwardly into the space vacated by the bottom wall minor portion 44.

Figure 1:
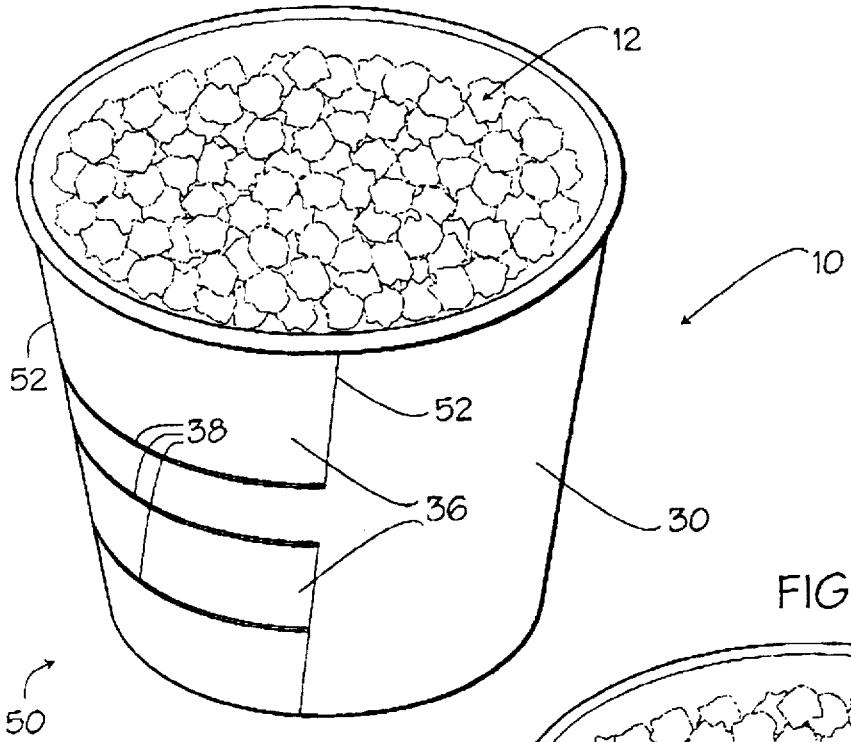
FIG. 1 is a perspective view of the preferred embodiment of the present invention as used for holding popcorn.

In use, the container 10 may, without any folding, be used as a popcorn bucket as shown in FIG. 1. When it is desired to carry a drink cup with the popcorn bucket then the sidewall minor portion 36 may be folded inwardly as shown in FIG. 2 for accommodating a long drink cup 20 as best seen in FIGS. 2, and 6. The space accommodated by encircling member 65 is such as to prevent the drink cup 20 from falling downwardly within member 65. The drink cup 20 has a conical, tapered shape and preferably a lip on it opening 22. Lips 22 and 32 preferably overlap. This overlap condition as well as the conical shape of the cup 20 prevent the cup 20 from moving through the encircling member 65, and are designed and sized to hold the cup 20 at a preferred position relative to the container 10. When a short cup, as seen in FIGS. 2 and 6 is used with the container 10, a sidewall minor portion lower portion 38 is not folded inwardly, so that the short cup 20 is able to rest upon a lower portion upper edge 38E of this lower portion 38.

Figure 3:
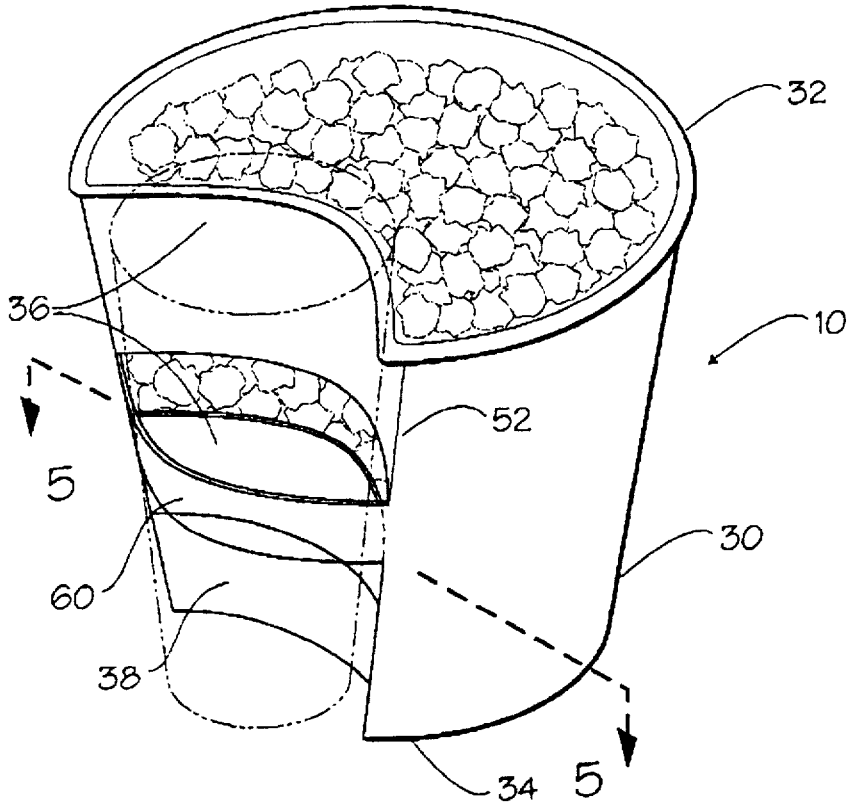
FIG. 3 is a perspective view of the preferred embodiment of the present invention as used for holding popcorn and as folded for holding a long drink cup.

When a longer cup 10 is used as shown in FIGS. 3 and 7, it is desired to allow the cup to extend below the upper edge 38E. In this case, as shown in FIGS. 4 and 5, bottom wall minor portion 44 is folded upwardly along fold line 44F into contact with lower portion 38 and then the bottom wall minor portion 44 as well as lower portion 38 are pressed inwardly into the position shown in FIG. 5. J This provides space for the longer cup 20 to be mounted into encircling member 65 and also be able to be positioned as shown in FIGS. 3 and 7. The size of encircling member 65 is constructed so as to restrain longer cup 20 from moving downwardly when the container 10 is carried and the cup 20 itself is not manually supported.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A food container device for use with at least one drink cup, the device comprising: a generally circular sidewall providing a top and a bottom annular lips, the lips defining a top and a bottom respective openings into the container;

a disk shaped bottom wall joined with the sidewall and positioned for covering the bottom opening;

the sidewall providing at least one cup holding enablement, each of the at least one cup holding enablements comprising:

a first and a second linear score lines extending between the top and the bottom lips for folding a minor portion of the sidewall inwardly;

a plurality of, spaced apart slits, each of the slits extending between the first and the second linear score lines for enabling at least one band portion of the minor portion of the sidewall to extend outwardly when the minor portion of the sidewall is folded inwardly, the outwardly extending band portion, and the inwardly folded minor portion of the sidewall, together, forming an encircling member for holding one of the at least one drink cup securely on the food container device.

2. The device of claim 1 wherein, for each one of the at least one cup holding enablements, each of the first and second linear score lines are downwardly convergent.

3. The device of claim 2 wherein, for each one of the at least one cup holding enablements, each of the plurality of slits is two slits.

4. The device of claim 2 wherein, for each one of the at least one cup holding enablements, each of the plurality of slits is three slits.

5. The device of claim 4 wherein the disk shaped bottom wall includes, for each one of the at least one cup holding enablements, an arcuate slit thereon, the arcuate slit extending between a first and a second positions on the sidewall to define a minor portion of the bottom wall between the arcuate slit and the sidewall, so that with the minor portion of the bottom wall folded against the sidewall, the sidewall may be folded into the space vacated by the minor portion of the bottom wall.

6. A combination food and drink container device comprising:

a) at least one drink cup;

b) a generally circular sidewall providing a top and a bottom annular lips, the lips defining a top and a bottom respective openings into the container device;

a disk shaped bottom wall joined with the sidewall and positioned for covering the bottom opening;

the sidewall providing at least one cup holding enablement, each of the at least one cup holding enablements comprising:

a first and a second linear score lines extending between the top and the bottom lips for folding a minor portion of the sidewall inwardly;

a plurality of, spaced apart slits, each of the slits extending between the first and the second linear score lines for enabling at least one band portion of the minor portion of the sidewall to extend outwardly when the minor portion of the sidewall is folded inwardly, the outwardly extending band portion, and the inwardly folded minor portion of the sidewall, together, forming an encircling member for holding one of the at least one drink cup securely on the food container device.

7. The device of claim 6 wherein, for each one of the at least one cup holding enablements, each of the first and second linear score lines are downwardly convergent.

8. The device of claim 7 wherein, for each one of the at least one cup holding enablements, each of the plurality of slits is two slits.

9. The device of claim 7 wherein, for each one of the at least one cup holding enablements, each of the plurality of slits is three slits.

10. The device of claim 9 wherein the disk shaped bottom wall includes, for each one of the at least one cup holding enablements, an arcuate slit thereon, the arcuate slit extending between a first and a second positions on the sidewall to define a minor portion of the bottom wall between the arcuate slit and the sidewall, so that with the minor portion of the bottom wall folded against the sidewall, the sidewall may be folded into the space vacated by the minor portion of the bottom wall.

* * * * *